US006284957B1

(12) United States Patent
Leguia

(10) Patent No.: US 6,284,957 B1
(45) Date of Patent: Sep. 4, 2001

(54) CARBON FIBER CELLO

(76) Inventor: Luis G. Leguia, 256 Edgehill Rd., Milton, MA (US) 02186

( * ) Notice: Subject to any disclaimer, the term of this patent is extended or adjusted under 35 U.S.C. 154(b) by 0 days.

(21) Appl. No.: 09/474,902

(22) Filed: Dec. 30, 1999

Related U.S. Application Data

(63) Continuation-in-part of application No. 09/094,549, filed on Jun. 12, 1998, now abandoned.
(60) Provisional application No. 60/049,372, filed on Jun. 12, 1997.

(51) Int. Cl.[7] ..... G10D 1/02
(52) U.S. Cl. ..... 84/275; 84/291
(58) Field of Search ..... 84/274, 275, 290, 84/291, 452 R

(56) References Cited

U.S. PATENT DOCUMENTS

| | | |
|---|---|---|
| 563,689 | 7/1896 | Renner . |
| 629,374 | 7/1899 | Kindig . |
| 711,104 | 10/1902 | Gabrielson . |
| 1,384,492 | 7/1921 | Sivard . |
| 1,419,440 | 6/1922 | Ashley . |
| 1,459,057 | 6/1923 | Jones . |
| 1,668,832 | 5/1928 | Swanson . |
| 1,802,250 | 4/1931 | Gruppe . |
| 1,941,595 | 1/1934 | Burdick . |
| 2,141,735 | 12/1938 | Borg . |
| 2,208,081 | 7/1940 | Proebstel . |
| 2,236,701 | 4/1941 | Virzi . |
| 2,588,101 | 3/1952 | Finder . |
| 2,770,156 | 11/1956 | Bowman . |
| 2,793,556 | 5/1957 | Maccaferri . |
| 3,186,288 | 6/1965 | Finch . |
| 3,241,417 | 3/1966 | Meinel . |
| 3,427,915 | 2/1969 | Mooney . |
| 3,483,785 | 12/1969 | Tansky . |
| 3,699,836 | 10/1972 | Glasser . |
| 3,911,778 | 10/1975 | Martin . |
| 3,969,971 | 7/1976 | Delu . |
| 4,088,050 | 5/1978 | Appel . |
| 4,090,427 | 5/1978 | Kaman . |
| 4,144,793 | 3/1979 | Solka . |
| 4,145,948 | 3/1979 | Turner . |
| 4,161,130 | 7/1979 | Lieber . |
| 4,290,336 | 9/1981 | Peavey . |
| 4,304,164 | 12/1981 | Baker . |
| 4,313,362 | 2/1982 | Lieber . |
| 4,320,684 | 3/1982 | Podunavac . |
| 4,408,516 | 10/1983 | John . |
| 4,592,264 | 6/1986 | Svoboda . |
| 4,809,579 | 3/1989 | Maccaferri . |
| 4,836,076 | 6/1989 | Bernier . |
| 4,846,039 | 7/1989 | Mosher . |
| 4,873,907 | 10/1989 | Decker . |
| 4,955,274 | 9/1990 | Stephens . |
| 4,969,381 | 11/1990 | Decker . |
| 5,171,926 | 12/1992 | Besnainou . |
| 5,333,527 | 8/1994 | Janes . |
| 5,537,906 | 7/1996 | Steinberger . |
| 5,955,688 * | 9/1999 | Cook ..... 84/291 |

FOREIGN PATENT DOCUMENTS

| | | |
|---|---|---|
| 89625 | 1/1922 | (AT) . |
| 332655 | 2/1921 | (DE) . |
| 278668 | 12/1927 | (GB) . |

* cited by examiner

*Primary Examiner*—Jeffrey Donels
(74) *Attorney, Agent, or Firm*—Lawrence R. Franklin

(57) ABSTRACT

A carbon fiber cello has upper, middle, and lower bouts which smoothly merge into each other, a neck, back and sides which are molded in one piece from carbon fibers in which the back and sides are joined by smooth, round corners. The interior resonant cavity is free of protusions with the exception of the bass bar, soundpost, endpin support, and endpin.

27 Claims, 8 Drawing Sheets

CARBON FIBER CELLO

RELATED APPLICATION

This application claims the benefit of U.S. Provisional Application No. 60/049,372, filed Jun. 12, 1997, the entire teachings of which are incorporated herein by reference.

This is a Continuation-in-Part of applicant's Utility patent application Ser. No. 09/094,549, filed Jun. 12, 1998, now abandoned.

FIELD OF THE INVENTION

The present invention is directed to a cello in which the parts thereof are molded from carbon fibers.

BACKGROUND OF THE INVENTION

DESCRIPTION OF RELATED ART

There have been numerous attempts to construct a musical instrument of the violin family, i.e., a violin, a viola, a cello, and a string bass, also referred to as a double bass, of synthetic materials, specifically, fiberglass, carbon fibers, and graphite fibers. None have been particularly successful in the marketplace, principally due to their lack of a satisfactory tone and/or power, i.e., projection. Patented examples include: U.S. Pat. No. 3,186,288 to Finch; U.S. Pat. No. 3,427,915 to Mooney; U.S. Pat. No. 3,699,836 to Glasser; U.S. Pat. No. 3,969,971 to Delu; U.S. Pat. No. 4,408,516 to John; U.S. Pat. No. 4,592,264 to Svoboda; U.S. Pat. No. 4,809,579 to Maccaferri; U.S. Pat. No. 4,836,076 to Bernier; U.S. Pat. No. 4,955,274 to Stephens; and U.S. Pat. No. 5,171,926 to Besnainou et al.

The history of musical instruments, especially stringed instruments of the violin family, has underscored the old adage that you can't tell a book by its cover. For the last several centuries, the standard for violins and cellos has been the Stradivarius. Its shape especially has been copied regardless of the materials or manufacturing techniques developed. Yet, the difference in playability has been all too apparent. In most instances, the Stradivarius looks the same as the newly formed instrument. All corresponding parts are of essentially the same size and shape, they are joined together in virtually the same manner, and they look almost identical. Yet, even to an untrained ear, the difference in the way they sound and the way they project their music explains the six-figure difference in their cost. The cause of the differences in musical quality ultimately resides in the overall combination of shape and materials.

Changes in materials, carbon fibers for example, when compared to the usual wooden bodies of the violin family, changes the resonance and timbre of the vibrations produced thereby, which would seem to require other changes elsewhere in compensation, if one wished to emulate the accepted standard. For some inventors, the form of the Stradivarius is basic, sacrosanct. See Finch and Maccaferri, supra, for instance. In order to compensate for a change in materials, in an attempt to bring the tonal qualities thereof back to the desired norm, other inventors have modified the resonant cavity within the body; see Delu, Bernier, and Stephens, supra. Others have concentrated on the make-up of the soundboard or back; see Mooney, Glasser, John, and Besnainou et al., supra. Finally, others, e.g., Svoboda, supra, have combined disparate materials to achieve the desired tone. The results have not been happy ones. The combination of changes necessary to produce a quality instrument has eluded those skilled in the art. The meagre number of patents in this field in the last decade attests to the bewilderment prevalent in the field.

Any change in such an established commodity is bound to be simple, perhaps even known in the art separately in bits and pieces. But, the readily available changes are so abundant, the permutations and combinations are virtually innumerable, and the right combination for a successful instrument is very easy to overlook. The inventor, a concert cellist for the Boston Symphony Orchestra, has found the right combination after years of experimentation. The prototype for this disclosure has been played in concerts with the BSO as well as in personal recitals. Its quality has been proven to be acceptable at the highest level!

OBJECTS AND SUMMARY OF THE INVENTION

An object of the invention is to provide a cello which has a purity of sound and power of projection to allow it to favorably compete with currently used cellos, while being relatively economical to produce.

Another object of the invention is to provide a cello which is more durable and resistant to the damages incurred by transport and use thereof.

The present invention accomplishes the above by providing a cello made from carbon fibers in which:

- the back, sides, and neck are integrally molded into a unitary unit;
- the soundboard and back are smoothly, gently arched longitudinally and transversely of the cello body;
- the edges where the back and sides meet are smoothly rounded;
- the body departs from the traditional shape of cellos and other members of the violin family by eliminating the cornices by smoothly curving the midsections between the upper and lower bouts to more closely approach the general shape of an acoustic guitar body; and
- the interior of the body has been freed of sharp corners and extraneous dampening formations, duplicating the exterior smoothness of the walls in the interior and retaining therein only the bass bar, soundpost, endpin support, and endpin.

DETAILED DESCRIPTION OF THE INVENTION

Figure 1:
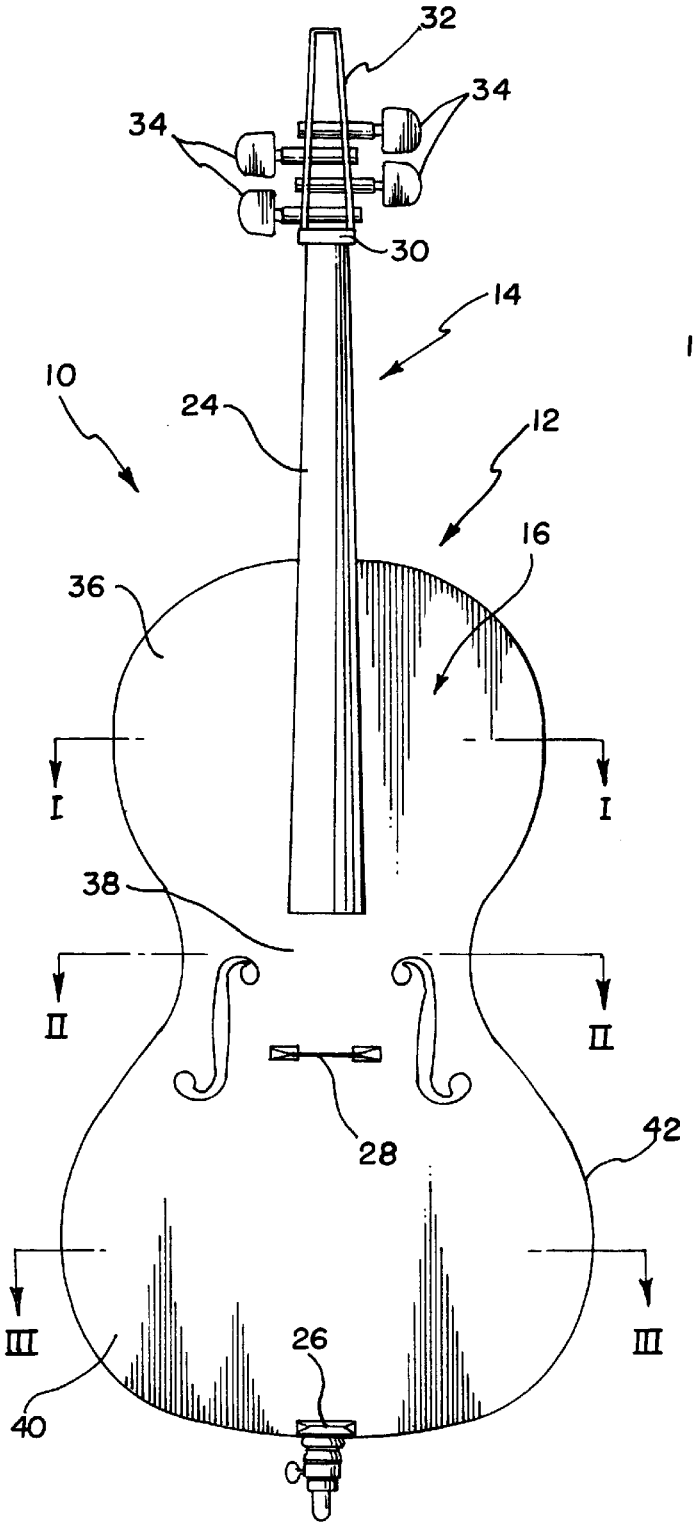
FIG. 1 is a front view of the preferred embodiment of the inventive cello shown without the strings.
Figure 2:
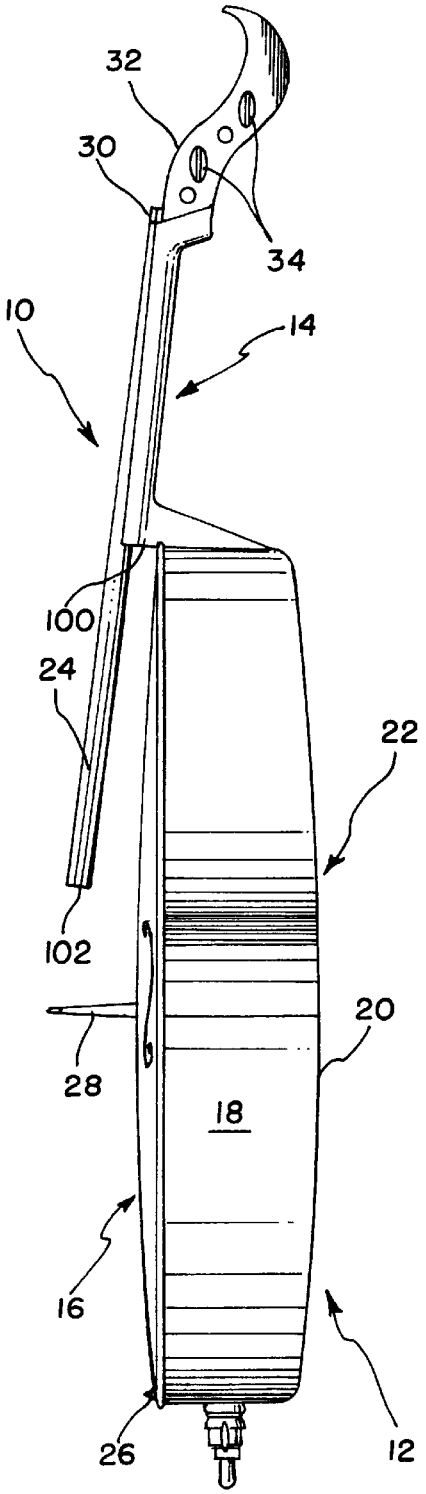
FIG. 2 is a side view of the cello of FIG. 1.

Referring to FIGS. 1–2, the present invention is directed to a cello 10 comprising a body 12 and a neck 14. Body 12 comprises, when assembled, a soundboard 16, sides 18, and a back 20. Sides 18 are in actuality a single, continuous side which extends completely around body 12 of cello 10, but it is traditional to refer to sides 18, often called "ribs" in the art, in the plural. Neck 14 extends upwardly from body 12, when cello 10 is in its playing position (FIG. 1), is preferably hollow, and is closed at both ends. All of these components are made of carbon fibers laid up in an epoxy resin and molded to shape.

Figure 3:
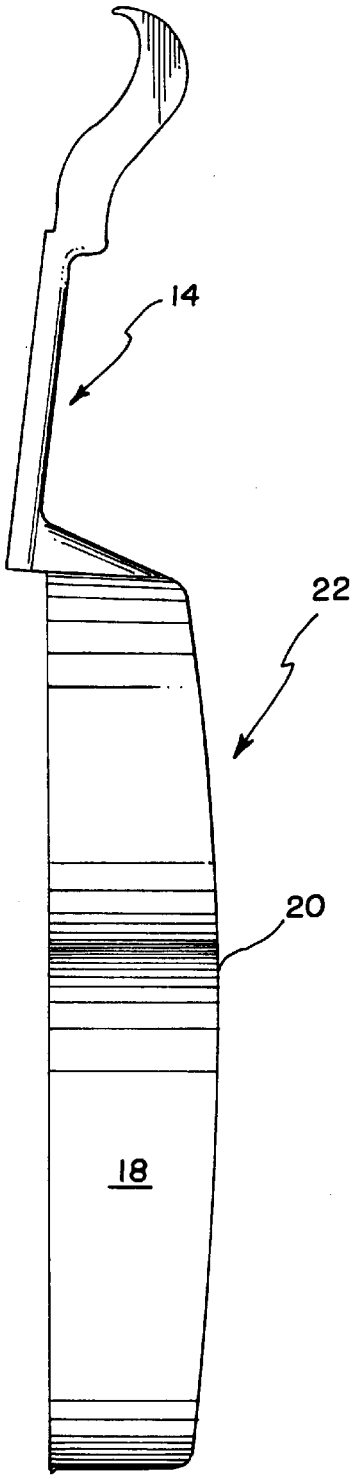
FIG. 3 is a side view of the unitary body and neck of the cello of FIG. 1.

A major feature of the invention is the molding into a single unit 22 of back 20, sides 18, and neck 14. A side view of the unitary molded unit 22 comprising back 20, sides 18, and neck 14 is shown in FIG. 3 without soundboard 16. The unitary molding of back, sides, and neck provides a solid structure having surprising resonant qualities, including an unexpectedly powerful projection.

Figure 20:
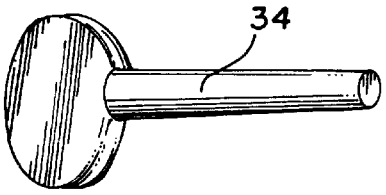
FIG. 20 shows a tuning peg usable with the cello of FIG. 1.

Returning to FIGS. 1–2, soundboard 16 is affixed to unit 22, and a fingerboard 24 is affixed to neck 14. Saddle 26 is affixed to soundboard 16, and bridge 28 rests thereon. A nut 30 is located on neck 14 adjacent a hollow peg box 32 to which pegs 34 are attached for tuning the strings (not shown). All function in the conventional manner. Saddle 26 and nut 30 are preferably separate elements, most likely made of ebony, which are secured to the instrument after soundboard 16 and fingerboard 24 have been affixed to unitary unit 22. Saddle 26 is adhered to the top of soundboard 16 at its base, and nut 30 is secured over the juncture of fingerboard 24 and peg box 32 at the end of neck 14. It is within the scope of the claims, however, that saddle 26 could be integrally molded with soundboard 16, and nut 30 be integrally molded with either fingerboard 24 or neck 14. Pegs 34 (FIG. 20) are made of carbon fibers and are conventionally shaped. They may or may not be hollow.

The other major feature of cello 10 is the shape of body 12 as shown in FIGS. 1–8.

Figure 4:
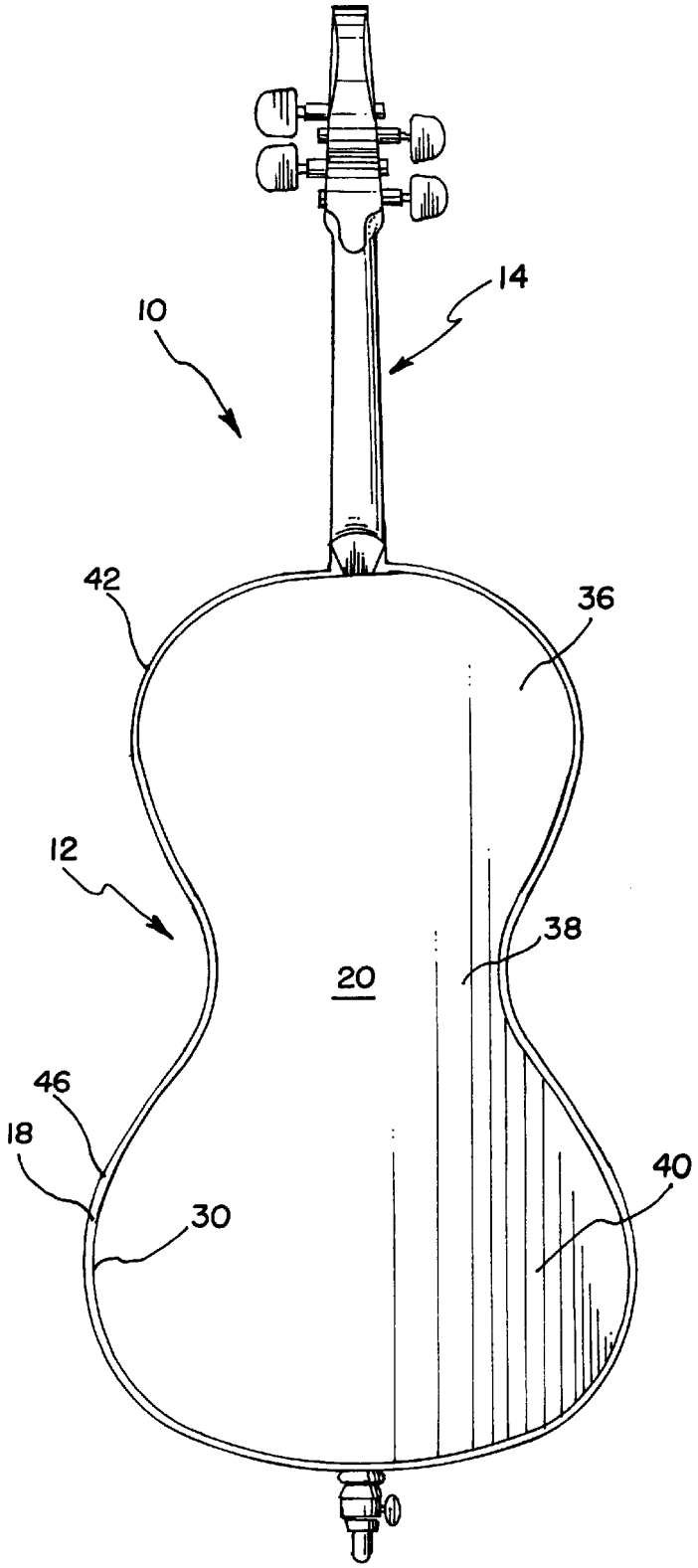
FIG. 4 is a back view of the cello of FIG. 1.

The front view shown in FIG. 1 and the back view shown in FIG. 4 show body 12 to comprise an upper bout 36, a middle bout 38 (also referred to in the art as a waist, cut-out, or C-bout), and a lower bout 40. The perimetrical contour 42 of body 12 as shown in FIGS. 1 and 4 are proportional to the preferred embodiment, but this is for illustrative purposes only, for variations thereof are permissible within the inventive concepts disclosed and claimed herein. The invention, of course, is limited only by the appended claims. As can be seen, upper bout is integrally joined to lower bout by a pair of smoothly curved, inwardly bowed midsections which comprise middle bout 38. Note that the usual cornices, those sharply cornered projections found on conventional cellos and other members of the violin family at the junctures of the upper and lower bouts with the middle bout, are not present on the inventive cello 10. (For clarity and completeness of disclosure, the structure referred to herein as "cornices" are also called "points" (see Sivard, U.S. Pat. No. 1,384,492 and Svoboda, supra, both incorporated by reference) or "corners" (see Meinel, U.S. Pat. No. 3,241,417, and Bernier, supra, both incorporated by reference). All are accepted terms in the art.) Elimination of the cornices, and the blocks inside the instrument bodies opposite the cornices, is made possible by body 12 being constructed of carbon fibers, which renders body 12 strong enough not to require those standard cello cornices. But, the inventor has not eliminated them simply because it can be done; the elimination of the cornices and internal blocks are primarily for acoustical reasons. The result is that body 12 more closely resembles a fine acoustic guitar than a conventional wooden cello in external shape, and thus is free of vibration dampeners internally and externally.

The elimination of the usual cornices is a major step away from the conventional wisdom in the art. It is well known that the internal resonance is a function of the internal shape of the instrument body, and the inclusion of sharp reflective corners affects the quality of the tones projected therefrom. And, it is also known that the mass of the cornices exteriorly of the body and the corner blocks internally affects the dampening characteristics of the instrument, as does any mass inclusive of the body. All of the aforementioned patents in the violin family art have incorporated a sharp exterior corner and, with the exception of Stephens, a sharp interior corner as well in their designs. (Stephens departs from the norm by including massive internal ribs which also alters the internal resonance of his violin.) In contrast, in the instant invention, all changes in surface directions are smooth and gentle, and are effected solely by the walls of body 12. Due to the elimination of the sharp corners, interiorly and exteriorly, the resonant cavity enclosed by the cello disclosed herein reflects the sound waves in a supportive manner, and the dampening is such that the overall result is a smooth, full sound.

Figure 5:
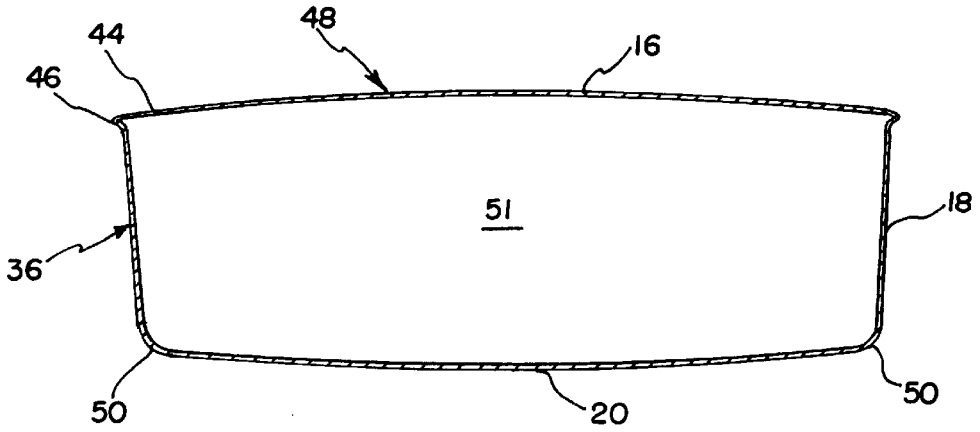
FIG. 5 is a cross-sectional transverse view of the upper bout of the cello of FIG. 1 as seen along the lines I—I of FIG. 1.
Figure 6:
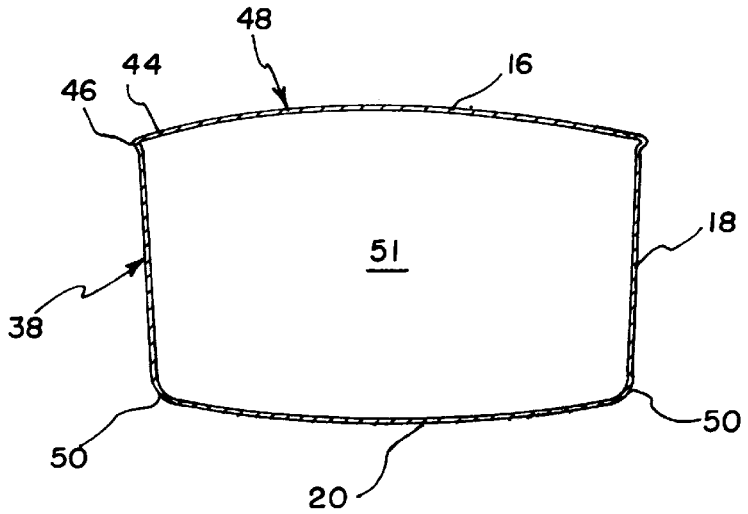
FIG. 6 is a cross-sectional transverse view of the middle bout of the cello of FIG. 1 as seen along the lines II—II of FIG. 1.
Figure 7:
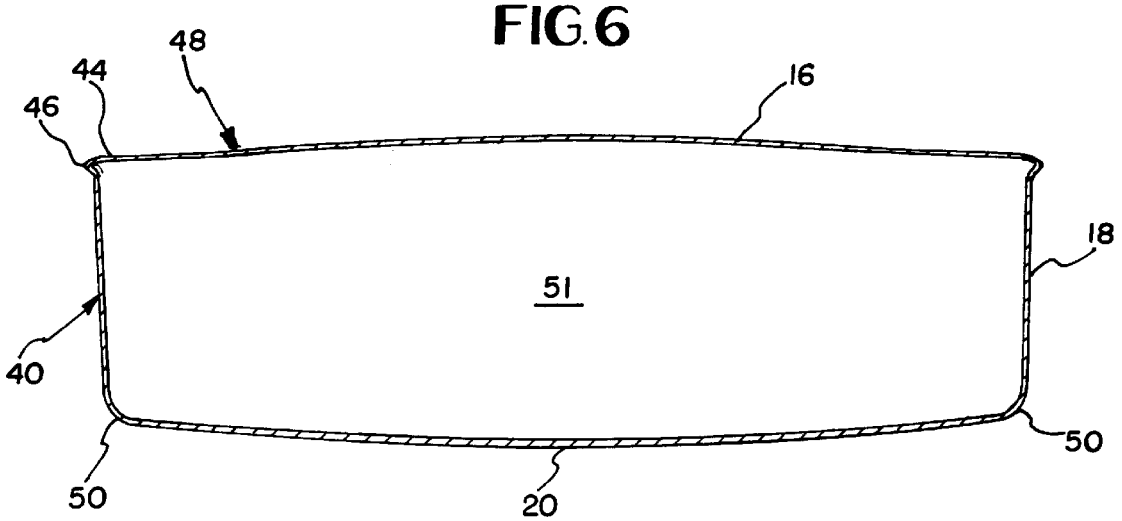
FIG. 7 is a cross-sectional transverse view of the lower bout of the cello of FIG. 1 as seen along the lines III—III of FIG. 1.

Equally important to the quality of the musical emissions from body 12 is the effect on the resonant cavity of the shape of soundboard 16, sides 18, and back 20. FIG. 2 shows, again to scale, the relative shapes of the longitudinal curvatures of soundboard 16 and back 20, which gently diverge from each end to a maximum substantially under bridge 28. FIGS. 5, 6, and 7 show, to scale, the relative dimensions of the upper, middle, and lower bouts 36, 38, and 40, respectively, along the lines II—I, II—II, and III—III of FIG. 1. The relative transverse curvatures of soundboard 16 and back 20 of upper, middle, and lower bouts 36, 38, and 40, respectively, are clearly shown. (The same scale relative to the preferred cello applies to FIGS. 5–7, but the scale of FIG. 1, although also proportional to the preferred cello, is different than that of FIGS. 5–7.) Soundboard 16 has an almost imperceptible, narrow, virtually flat strip 44 adjacent its juncture 46 with sides 18 which blends smoothly into a smooth arch 48 across soundboard 16. Sides 18 converge from juncture 46 toward back 20 where they merge therewith via smooth, rounded corners 50. In FIG. 4, sides 18 are visible between the double lines around the periphery 42 of body 12, representing juncture 46 and corners 50, respectively, due to the convergence of sides 18. Back 20 arches gently from side to side transverse body 12 (FIGS. 5–7). Note also the smooth, uncluttered interior 51. The kind and number of interior reflectors are kept to the bare minimum, namely, a bass bar, a soundpost, the endpin support, and the endpin; also see FIG. 9. The scientific explanation for the acoustically improved tonal qualities resulting from rounding the corners and smoothly arching the soundboard and back is outside of the inventor's expertise, but the difference to his trained ear was immediate and dramatic when they were incorporated into the design of body 12.

Figure 9:
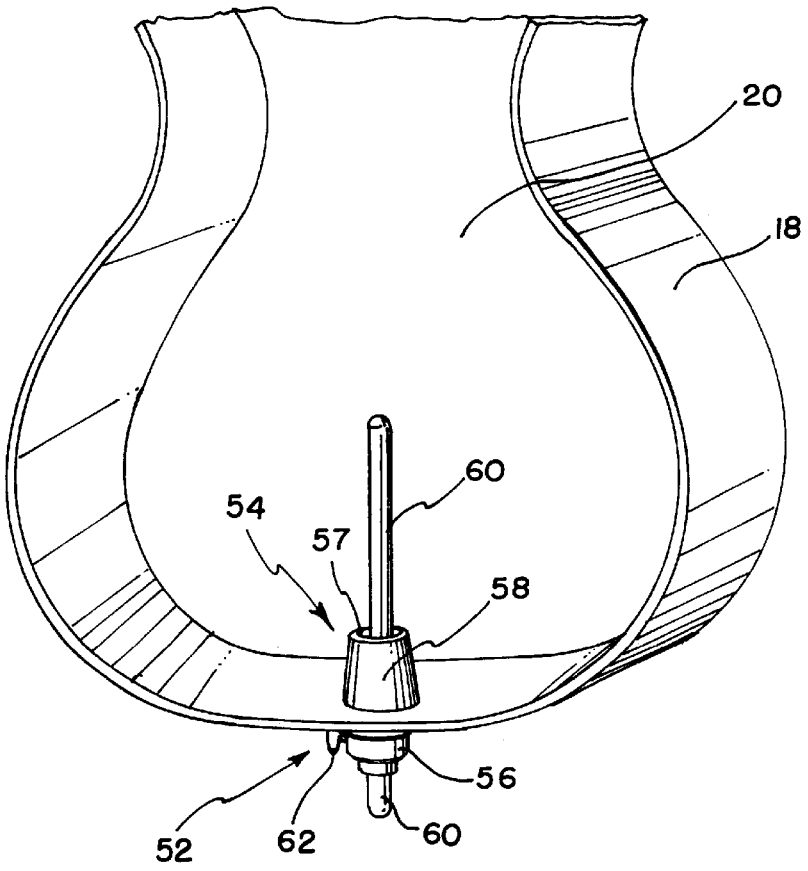
FIG. 9 is a view of the inside of part of the cello of FIG. 1 showing the details of the endpin support and the smooth interior of the middle bout.
Figure 8:
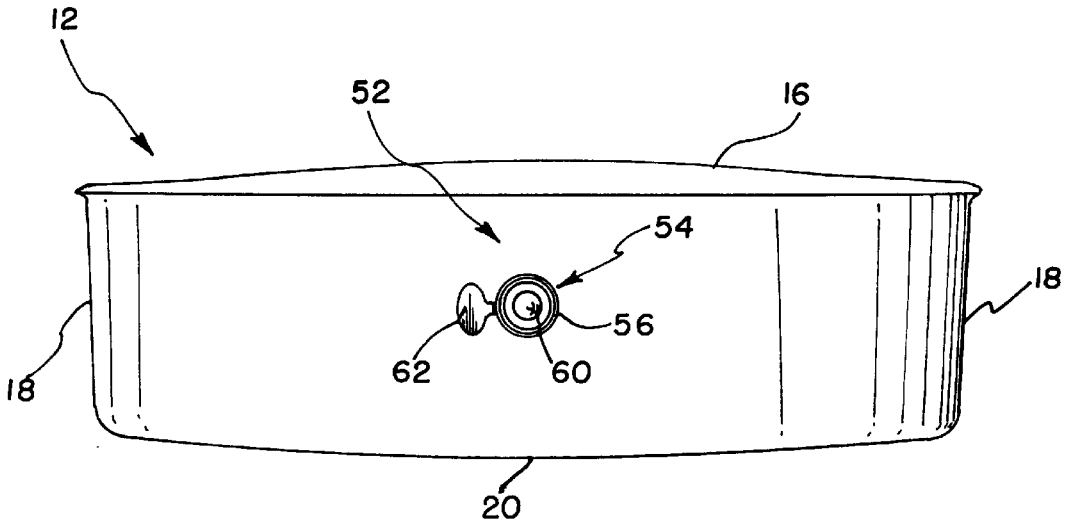
FIG. 8 is an end view of the cello of FIG. 1.

The end view of the bottom 52 of body 12 (FIG. 8) also shows the arching of soundboard 16 and back 20 and the convergence of sides 18. Centrally located in bottom 52 is an endpin holder 54, which comprises a cylindrical housing 56 resting against bottom 52 exteriorily of body 12 and an axially aligned interior support 58 (FIG. 9). A portion 57 of housing 56 extends through support 58, fitting snuggly within an enlarged bore (coincident with portion 57 in FIG. 9) in support 58. An axial bore through housing 56 receives an endpin 60. A conventional setscrew 62 laterally through housing 56 adjustably fixes endpin 60 at the proper extension from cello 10 to accommodate the physical build of the player thereof. Endpin support 58 is formed integrally with sides 18, when unit 22 is molded. Endpin housing 56 is conventional in the art and is held in place by the tension of the strings (not shown) which are attached to tuning pegs 34, passed over nut 30, bear on bridge 28 and are attached to a floating tail piece (not shown). As is conventional, a wire attached to the base of the tail piece passes over saddle 26 and is looped around housing 56 where it applies tension on housing 56 maintaining it solidly against bottom 52 of sides 18.

Figure 10:
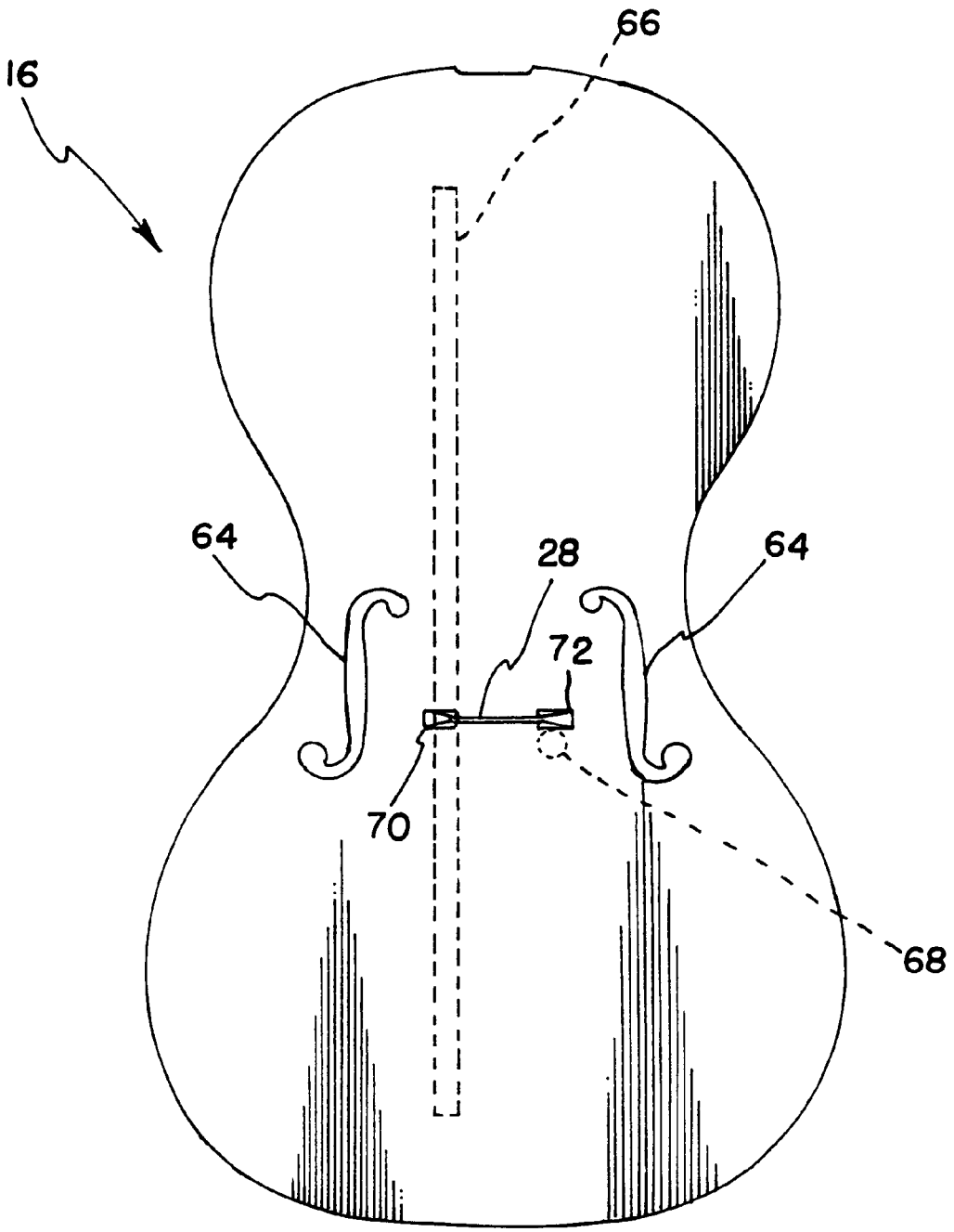
FIG. 10 is a top view of the soundboard of the inventive cello showing the relationships of the f-holes, bridge, bass bar, and sound post.

FIG. 10 shows the relative orientations on soundboard 16 of the two f-holes 64, bridge 28, a bass bar 66, and a soundpost 68. Bass bar 66 is affixed to the lower surface of soundboard 16 as is conventional. As can be clearly seen, f-holes 64 are spaced linearly outwardly from the two feet 70 and 72 of bridge 28, and the placement of bass bar 66 is as a normal wooden bass bar, i.e., it is located substantially under the left foot 70 of bridge 28. Soundpost 68 is force fit between soundboard 16 and back 20, again, as is conventional. Soundpost 68 is positioned as is a normal wooden sound post, that is, about 4–6 millimeters below the right foot 72 of bridge 28.

Figure 11:
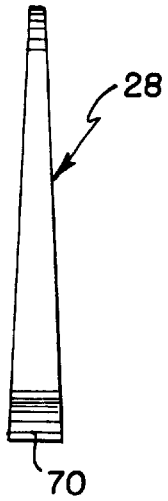
FIG. 11 is a side view of a bridge usable with the cello of FIG. 1.
Figure 12:
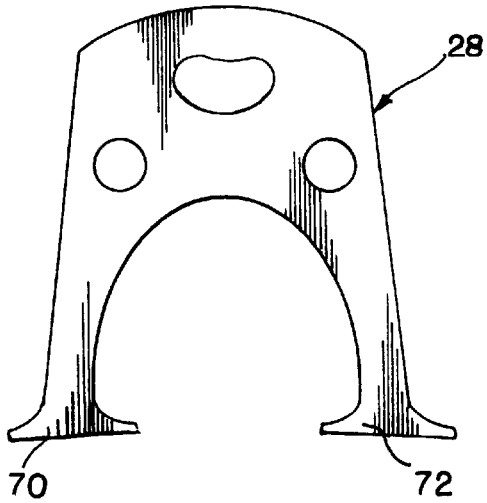
FIG. 12 is a front view of the bridge of FIG. 11.
Figure 13:
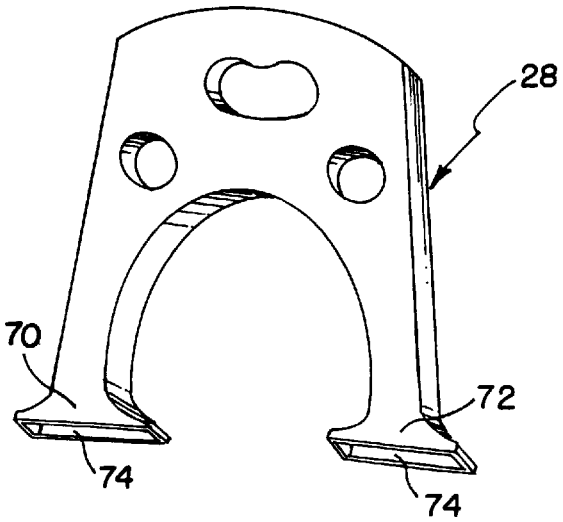
FIG. 13 is a perspective view of an alternative embodiment of the bridge of FIG. 11.

Referring to FIGS. 11–13, the details of bridge 28 are shown. Bridge 28 is preferably a wooden bridge made of maple and of conventional design. It is within the purview of the invention, however, that it too be fabricated of carbon fibers, in which case it is preferably hollow, opening through feet 70 and 72, as seen at 74 in FIG. 13, with the fibers running lengthwise up from feet 70 and 72. In addition, bridge 28 can be a sandwich of carbon fiber and either balsa wood, maple, or other sandwich material.

Figure 14:
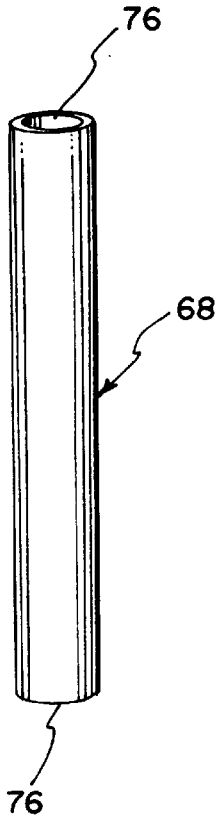
FIG. 14 is a perspective view of a soundpost for use within the cello of FIG. 1.

Soundpost 68 (FIG. 14) is preferably made of carbon fiber with unidirectional carbon running lengthwise (or longitudinally). It has the same diameter of a normal wooden soundpost, and is preferably hollow with open ends 76. Alternatively, both ends 76 can be closed off with carbon fiber. In addition, soundpost 68 can be filled with balsa wood, or spruce, or other sandwich material. A conventional spruce soundpost is also acceptable. The overall effect of the selection of soundpost 68 is to fine tune the tonal characteristics of carbon fiber cello 10 to the player's taste.

Figure 15:
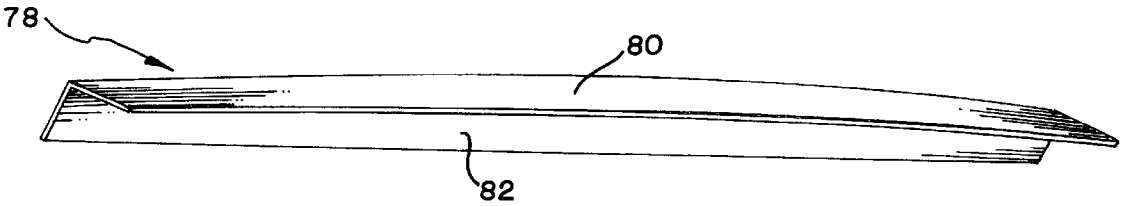
FIGS. 15–17 show perspective views of preferred embodiments of bass bars usable with the cello of FIG. 1.
Figure 16:
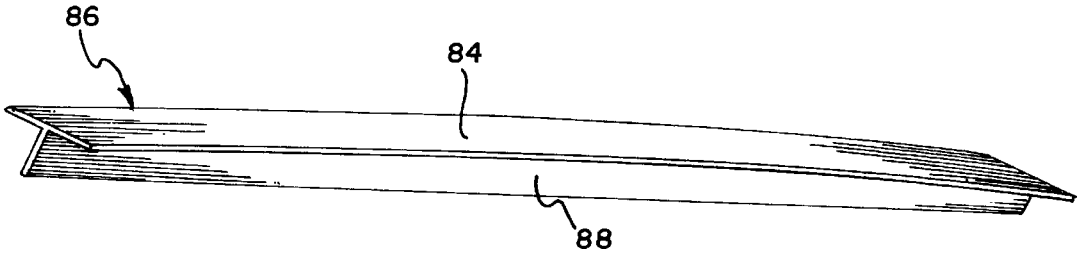
Figure 17:
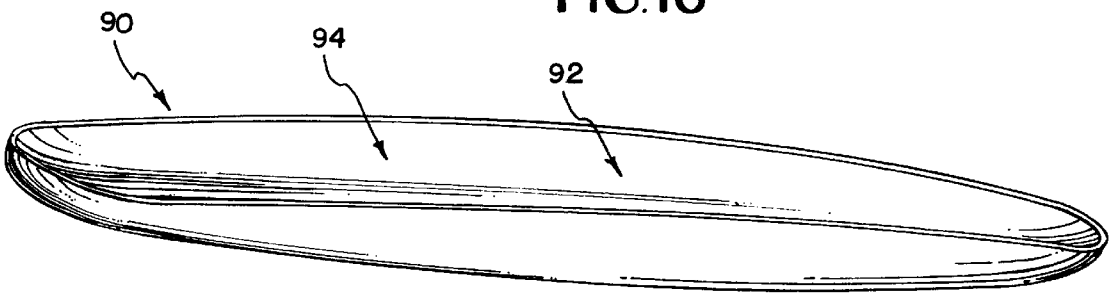

Three embodiments of bass bar 66 are shown in FIGS. 15–17, each preferably formed of unidirectional carbon fibers running lengthwise (or longitudinally) thereof, with the width, height, and length conforming substantially to normal, standard practice. Presently preferred is an L-shaped bass bar 78 (FIG. 15). The upper leg 80 of the L is slightly convexly curved to fit snuggly the interior longitudinal curvature of soundboard 16. The other leg 82 constitutes a support ridge which runs the full length of bass bar 78. Also preferred is the T-shaped bass bar 86 of FIG. 16, the top leg 84 of which is similarly curved complementary to the interior longitudinal curvature of soundboard 16. The lower leg 88 likewise constitutes a support ridge which runs the full length of bass bar 86. Alternatively, bass bar 90 (FIG. 17) can be used. Bass bar 90 has a hollow interior 92 with an open face 94 curved to fit soundboard 16. Bass bar 90 can comprise a sandwich of balsa wood, spruce, or another sandwich material with a carbon exterior (about 5 layers of carbon), or the open side 94 thereof can be enclosed with carbon fiber. Each of bass bars 78, 86, and 90 produce slightly different tonal effects, but opinions differ as to which is the most desirable. When used within body 12 as described herein, all are productive of acceptable pitch and timbre. The conventional wooden bass bass of spruce has been found acceptable as well.

Figure 18:
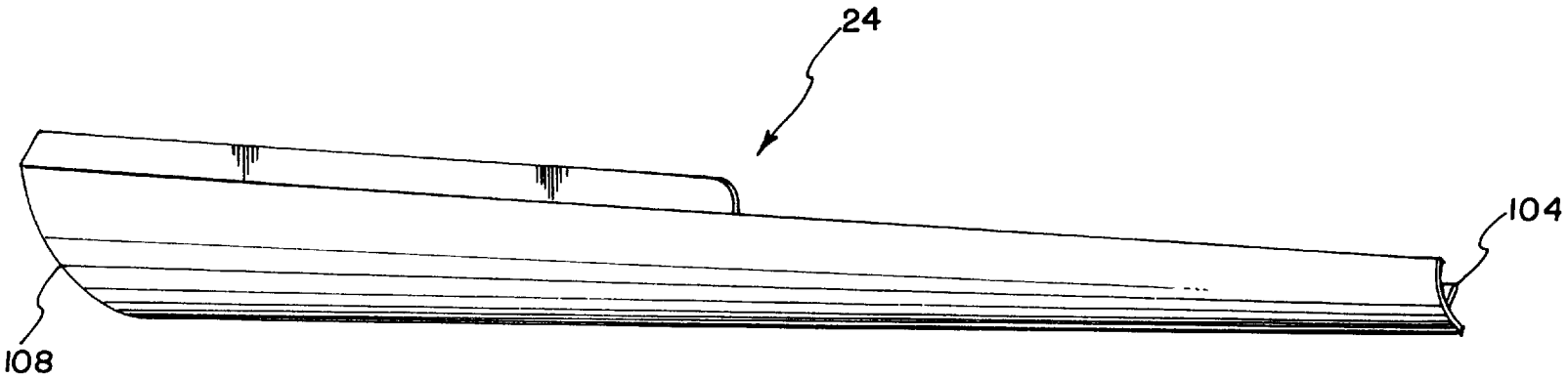
FIG. 18 is a front perspective view of the preferred fingerboard of the cello of FIG. 1.
Figure 19:
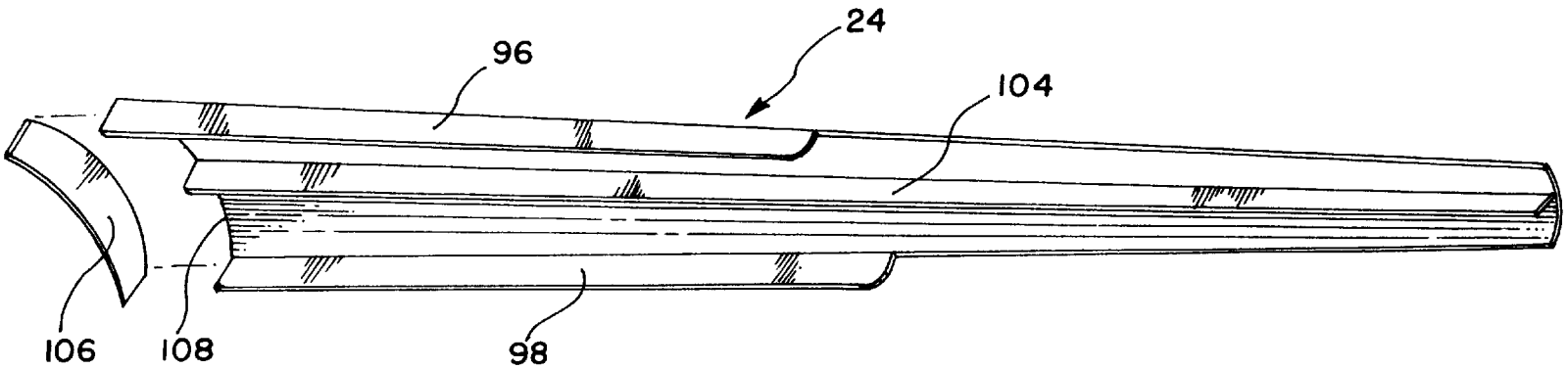
FIG. 19 is a rear perspective view of the fingerboard of the cello of FIG. 18 with an optional endcap exploded therefrom.

Referring to FIGS. 18–19, the preferred fingerboard 24 is made of unidirectional carbon fiber running lengthwise. It has three ridges for strength on the underside, two outside ridges 96 and 98 which extend from the end 100 of neck 14 (FIG. 2) to the free end 102 of fingerboard 24 cantilevered over soundboard 16, and a central ridge 104 which runs the length of fingerboard 24. Fingerboard 24 should be glued straight on the neck. Also, support ridge 104 should meet flush with the inside of the neck and also be glued thereto. Strands of carbon fiber are run from the side ridges 96 and 98 into the neck for strength. A facade 106 can be fitted to the free end 102 of fingerboard 24 for appearance. Although inclusion of facade 106 is functional, the preferred embodiment has free end 102 open to receive the sound waves emanating from soundboard 16 and to resonate therewith. A conventionally shaped fingerboard (not shown) without strengthening ridges can be affixed directly to neck 12 in less expensive versions of cello 10.

Equivalents

While this invention has been particularly shown and described with reference to a preferred embodiment, it will be understood by those skilled in the art that various changes in form and details may be made therein without departing from the spirit and scope of the invention as defined by the appended claims.

What is claimed is:

1. A cello, comprising:

a body and a neck;

said neck integrally including a peg box;

said body comprising a soundboard, a back, and sides;

said soundboard being molded of carbon fibers, being smoothly outwardly arched longitudinally and transversely, and including a pair of f-holes extending therethrough;

said back being smoothly outwardly arched longitudinally and transversely;

said sides converging from the perimeter of said soundboard to the perimeter of said back with said back and said sides merging together via smoothly rounded corners;

said neck, back, and sides being integrally molded of carbon fibers as a single unit, and said soundboard being fixedly attached to said sides to form said body;

said body enclosing a resonant cavity bounded by a top formed by said soundboard, a bottom formed by said back, and a sidewall formed by said sides, said sidewall being configured to comprise an upper bout contour and a lower bout contour integrally joined together by a middle bout contour, said contour of said upper bout being smoothly, convexly curved and including a pair of spaced-apart end portions, said contour of said lower bout being smoothly, convexly curved and including a pair of spaced-apart end portions, and said contour of said middle bout comprising a pair of smoothly curved, inwardly bowed, concave midsections, each of said pair of concave midsections being disposed on opposite sides of said middle bout, and each of said pair of concave midsections including first and second end portions, said first end portions of said pair of concave midsections being smoothly and integrally joined to a respective one of said pair of end portions of said upper bout contour, and said second end portions of said pair of concave midsections being smoothly and integrally joined to a respective one of said pair of end portions of said lower bout contour, wherein all of the junctures of said end portions of said upper and lower bout contours with said end portions of said middle bout contours are characterized by a smooth change from convexity to concavity with no external cornices nor internal corners;

an endpin support integrally formed within said body;

an endpin housing;

an endpin adjustably secured to and guided by said endpin housing and said endpin support;

a set of tuning pegs adjustably mounted to said peg box;

a fingerboard fixed to said neck;

a nut located proximate the juncture of said fingerboard and said peg box;

a bridge supported by said soundboard;

a set of strings extending over said bridge and said nut, and tunably attached to said set of pegs;

a bass bar affixed to the inner surface of said soundboard; and a soundpost fit between said soundboard and said back.

2. The cello of claim 1 wherein said bass bar is L-shaped and is made of carbon fibers.

3. The cello of claim 1 wherein said bass bar is T-shaped and is made of carbon fibers.

4. The cello of claim 1 wherein said bass bar is formed of carbon fibers into an elongated bar having a hollow interior with an open face, said open face being affixed to the underside of said soundboard.

5. The cello of claim 4 wherein said hollow interior is filled with wood.

6. The cello of claim 1 wherein said bass bar is made of wood.

7. The cello of claim 1 wherein said soundpost is made of carbon fibers.

8. The cello of claim 7 wherein said soundpost is a hollow cylinder.

9. The cello of claim 8 wherein said hollow cylinder is filled with wood.

10. The cello of claim 1 wherein said soundpost is made of wood.

11. The cello of claim 1 wherein said bridge is made of wood.

12. The cello of claim 1 wherein said bridge is made of carbon fibers.

13. The cello of claim 12 wherein said bridge has a hollow interior.

14. The cello of claim 13 wherein said bridge includes a pair of feet and said hollow interior opens through said feet.

15. The cello of claim 1 wherein said fingerboard is made of carbon fibers.

16. The cello of claim 15 wherein said fingerboard has an arched upper surface and three ridges extending downwardly from a lower surface.

17. The cello of claim 16 wherein said neck is joined with said body at a lower end, said fingerboard extends from said lower end of said neck over said soundboard to a free end, one of said three ridges is centrally located and extends the full length of said fingerboard and the other two ridges depend from opposite side edges of said fingerboard and extend from the free end of said fingerboard to the lower end of said neck.

18. The cello of claim 17 wherein said fingerboard and neck define therebetween a pair of elongated, hollow chambers, said chambers being open at the end facing said body.

19. The cello of claim 18 wherein a carbon fiber facade closes the end of said pair of chambers at said free end of said fingerboard.

20. The cello of claim 1 wherein said resonant cavity includes no protrusions therewithin except for said bass bar, said soundpost, said endpin support, and said end pin.

21. A carbon fiber cello, comprising:

a neck, back, and sides being integrally molded in one piece of carbon fibers, said back being slightly concave and rounded, and said back and said sides being joined together by smoothly rounded edges;

a soundboard molded of carbon fibers, said soundboard being upwardly bowed and including a pair of f-holes;

said soundboard being mounted to said sides opposite to said back to form a cello body having an upper bout and a lower bout integrally joined together by a pair of smoothly curved, inwardly bowed midsections with no cornices, said body enclosing a resonant cavity;

a carbon fiber endpin holder mounted on the inner wall of said side;

a carbon fiber saddle mounted on said front adjacent said endpin holder;

a hollow carbon fiber bass bar mounted to said front within said cavity;

a hollow, carbon fiber bridge placed on said front outside of said cavity;

a carbon fiber sound post, said sound post being placed within said cavity between said front and said back in the vicinity of the right foot of said bridge;

a fingerboard molded of carbon fibers, said fingerboard being upwardly arched with three depending ridges on the underside for strength, said fingerboard being glued to said neck; and a nut mounted on said fingerboard adjacent the end of fingerboard remote from said body.

22. The cello of claim 21 wherein said hollow bass bar includes a longitudinally extending open side, said open side being glued to said front.

23. The cello of claim 21 wherein said hollow bass bar comprises a sandwich formed of balsa wood and carbon fibers.

24. The cello of claim 21 wherein said hollow bridge has openings in the feet.

25. The cello of claim 21 wherein said fingerboard and neck define therebetween a pair of elongated, hollow chambers, said chambers being open at the end facing said body.

26. The cello of claim 25 wherein a carbon fiber facade closes said open end of said pair of chambers.

27. A musical instrument of the violin family, said violin family consisting of a violin, a viola, a cello, and a string bass, comprising:

a body and a neck;

said neck integrally including a peg box;

said body comprising a soundboard, a back, and sides;

said soundboard being molded of carbon fibers, being smoothly outwardly arched longitudinally and transversely, and including a pair of f-holes extending therethrough;

said back being smoothly outwardly arched longitudinally and transversely;

said sides converging from the perimeter of said soundboard to the perimeter of said back with said back and said sides merging together via smoothly rounded corners;

said neck, back, and sides being integrally molded of carbon fibers as a single unit, and said soundboard being fixedly attached to said sides to form said body;

said body enclosing a resonant cavity bounded by a top formed by said soundboard, a bottom formed by said back, and a sidewall formed by said sides, said sidewall being configured to comprise an upper bout contour and a lower bout contour integrally joined together by a middle bout contour, said contour of said upper bout being smoothly, convexly curved and including a pair of spaced-apart end portions, said contour of said lower bout being smoothly, convexly curved and including a pair of spaced-apart end portions, and said contour of said middle bout comprising a pair of smoothly curved, inwardly bowed, concave midsections, each of said pair of concave midsections being disposed on opposite sides of said middle bout, and each of said pair of concave midsections including first and second end portions, said first end portions of said pair of concave midsections being smoothly and integrally joined to a respective one of said pair of end portions of said upper bout contour, and said second end portions of said pair of concave midsections being smoothly and integrally joined to a respective one of said pair of end portions of said lower bout contour, wherein all of the junctures of said end portions of said upper and lower bout contours with said end portions of said middle bout contours are characterized by a smooth change from convexity to concavity with no external cornices nor internal corners;

an endpin support integrally formed within said body;

an endpin housing;

an endpin adjustably secured to and guided by said endpin housing and said endpin support;

a set of tuning pegs adjustably mounted to said peg box;

a fingerboard fixed to said neck;

a nut located proximate the juncture of said fingerboard and said peg box;

a bridge supported by said soundboard;

a set of strings extending over said bridge and said nut, and tunably attached to said set of pegs;

a bass bar affixed to the inner surface of said soundboard; and a soundpost fit between said soundboard and said back.

* * * * *